US005688737A

United States Patent [19]

Abe et al.

[11] Patent Number: 5,688,737

[45] Date of Patent: Nov. 18, 1997

[54] THERMAL TRANSFER RECORDING MEDIUM

[75] Inventors: Tetsuya Abe; Toshio Fukuda; Yoshio Fujiwara, all of Kanagawa, Japan

[73] Assignee: Sony Corporation, Tokyo, Japan

[21] Appl. No.: 496,435

[22] Filed: Jun. 29, 1995

Related U.S. Application Data

[63] Continuation of Ser. No. 981,772, Nov. 25, 1992, abandoned.

[30] Foreign Application Priority Data

Nov. 29, 1991 [JP] Japan ..... 3-316416

[51] Int. Cl.[6] ..... B41M 5/035; B41M 5/38

[52] U.S. Cl. ..... 503/227; 428/195; 428/913; 428/914

[58] Field of Search ..... 428/195, 913, 428/914; 503/227

[56] References Cited

FOREIGN PATENT DOCUMENTS 0 270 677 A1 6/1988 European Pat. Off. ..... 41/26

0 365 392 A1 4/1990 European Pat. Off. ..... 41/26

0 526 170 A3 2/1993 European Pat. Off. ..... 503/227

*Primary Examiner*—Bruce H. Hess

*Attorney, Agent, or Firm*—Limbach & Limbach LLP

[57] ABSTRACT

A thermal transfer recording medium comprises a substrate and an ink layer formed on the substrate. The ink layer comprises a first dye having a light absorption peak which has a maximum absorption wavelength, $\lambda_{max}$, of 420 to 500 nm and a half-value width of at least 100 nm, and a second dye having a light absorption peak which which has a maximum absorption wavelength, $\lambda_{max}$, of 570 to 650 nm and a half-value width of at least 100 nm. The ink layer may further comprise a third dye having a light absorption peak whose maximum absorption wavelength, $\lambda_{max}$, of 500 to 550 nm and/or a fourth dye having a light absorption peak whose maximum absorption wavelength, $\lambda_{max}$, of 620 to 680 nm. When a density-graded indication is made using the thermal transfer recording medium, there can be obtained images whose black hue shift is small in all the density range.

9 Claims, 5 Drawing Sheets

THERMAL TRANSFER RECORDING MEDIUM

This is a continuation of application Ser. No. 07,981,772 filed on Nov. 25, 1992, now abandoned.

BACKGROUND OF THE INVENTION

1. Field of The Invention

This invention relates to thermal transfer recording mediums which are adapted for use in video printers and more particularly, to a thermal transfer recording medium which ensures black color images of high quality without producing any hue shift in a density-graded indication.

2. Description of The Prior Art

For obtaining hard copies from video information, it is usual to use a thermal transfer recording medium which comprises a polyethylene terephthalate film and an ink layer formed on the film and made of a dispersion of a sublimable or thermally diffusable dye in a binder such as a cellulose ester resin. In order to obtain full color images using such a thermal transfer recording medium, it is principally necessary to employ a thermal transfer recording medium which has three ink layers of yellow, cyan and magenta colors. Where black color is formed from yellow, magenta and cyan colors, a difficulty is involved in that as will be clear from the spectra of FIG. 4, the yellow, cyan and magenta colors have, respectively, a high chroma, so that absorptions do not become flat in a full range of visible light. On the contrary, there appear low light absorption regions between the maximum absorption wavelengths of the yellow, magenta and cyan colors (arrow A of FIG. 4). Accordingly, if these three colors are blended, a pure black color is difficult to develop. To avoid this, it is general to use an ink layer of black color in addition to the ink layers of yellow, cyan and magenta colors.

Where a black color ink layer is formed in the thermal transfer recording medium, it is principally sufficient to have a dye, which has a flat absorption spectrum in a visible light region of from 380 to 780 nm as is schematically shown in FIG. 5, contained in an ink layer at high concentration. However, a dye which exhibits such characteristics when used singly has never been obtained at present. In practice, the ink layer for black color is formulated with several types of dyes whose maximum absorption wavelengths differ from one another so that light in a visible light region can be flatly absorbed.

However, with existing black color thermal transfer recording mediums wherein several types of dyes are employed, if the printing energy is change in order to indicate a density gradation, the degree of sublimation or thermal diffusion of the respective dyes is not changed depending on the printing energy. This presents the problem that a given monotone black image cannot be obtained in a full density range. For instance, there may be obtained black images which assume a reddish color at low density or black images assuming a bluish color at high density. Eventually, there arises the problem that the hue differs depending on the image density. More particularly, when images with different densities are subjected to measurement of values of a* and b* in the (CIE 1976)L*a*b* colorimetric system, the measurements undesirably exceed at least one of the ranges of the values of a* and b* ($-10 \leqq a \leqq 10$ and $-5 \leqq b^* \leqq 5$) within which the hue is not significantly varied.

Moreover, with the black color ink layer using several types of dyes, the light absorption does not become flat in a full range of visible light but there is produced a low light absorption region between the maximum absorption wavelengths of the respective dyes. To avoid this, it may occur to have dyes contained in the ink layer at high concentrations. If dyes are contained in the ink layer at very high concentrations, they may be crystallized during storage or transport of the thermal transfer recording medium or blocking may take place, with the attendant problem that the storage property of the medium is lowered.

SUMMARY OF THE INVENTION

It is an object of the invention to provide a thermal transfer recording medium which solves the problems of the prior art and which suffers little hue shift of black images in a full density range when the image is reproduced in density-graded indication, with a good storage property.

It is another object of the invention to provide a thermal transfer recording medium of type mentioned above which is realized by the use of a minimum number of dyes.

The above objects can be achieved, according to the invention, by a thermal transfer recording medium which comprises a substrate and an ink layer formed on the substrate, the ink layer comprising a first dye having a light absorption peak which has a maximum absorption wavelength, $\lambda_{max}$, of 420 to 500 nm and a half-value width of at least 100 nm, and a second dye having a light absorption peak which which has a maximum absorption wavelength, $\lambda_{max}$, of 570 to 850 nm and a half-value width of at least 100 nm.

According to the invention, when the medium is subjected to indication by density-graded, there can be obtained images which suffer a reduced degree of black color hue shift in a full density range.

DETAILED DESCRIPTION OF THE INVENTION

The invention is based on the finding that there is not known any dye which has a flat, intense light absorption in a visible light full range but there are dyes which have a maximum light absorption wavelength within a visible light range and which has a light absorption peak with a broad half-value width of at least 100 nm. If at least two dyes are contained in an ink layer of a thermal transfer recording medium such that maximum absorption wavelengths are not superposed, the resulting ink layer can realize a uniform, intense light absorption over a visible light full range.

The ink layer formed on a substrate should contain at least a first dye having a light absorption peak which has a maximum absorption wavelength, $\lambda_{max}$, of 420 to 500 nm and a half-value width of at least 100 nm, and a second dye having a light absorption peak which has a maximum absorption wavelength, $\lambda_{max}$, of 570 to 650 nm and a half-value width of at least 100 nm.

In addition to the first and second dyes, there may be added a third dye which has a maximum absorption wavelength, $\lambda_{max}$, of 500 to 550 nm and/or a fourth dye having a light absorption peak, $\lambda_{max}$, of 620 to 680 nm.

Figure 1:
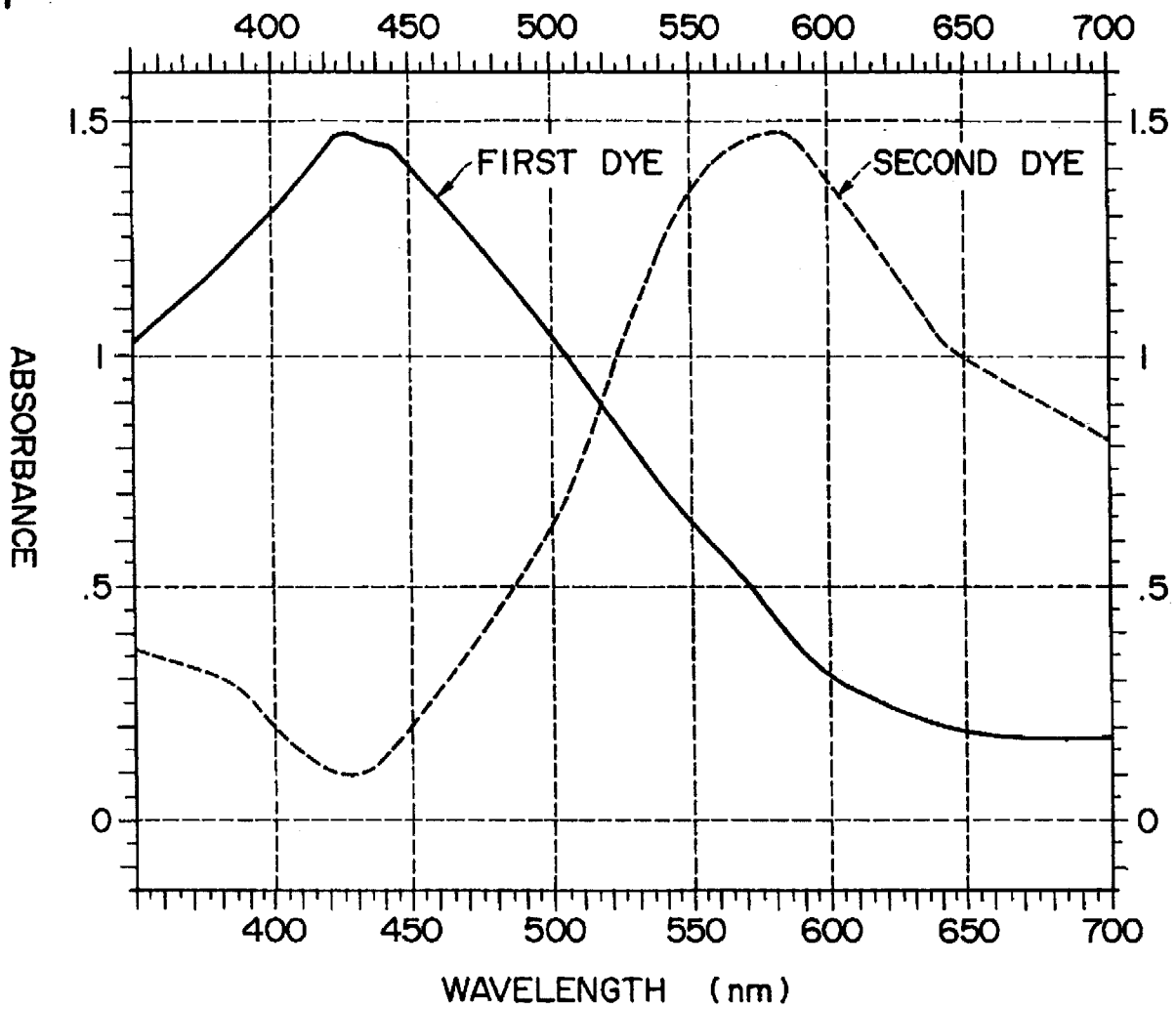
FIG. 1 is a graph showing a light absorption characteristic of different dyes used in combination according to one embodiment of the invention.

As stated above, the ink layer contains a first dye having a light absorption peak which has a maximum absorption wavelength, $\lambda_{max}$, of 420 to 500 nm and a half-value width of at least 100 nm and a second dye having a light absorption peak which has a maximum absorption wavelength, $\lambda_{max}$, of 570 to 650 nm and a half-value width of at least 100 nm. The light absorption characteristic of the dyes in the visible light range is schematically shown in FIG. 1. As will become apparent from the figure, the combination of at least two dyes having, respectively, such a light absorption characteristic as shown results in a great light absorption over a full range of visible light, making it possible to form a black color image. Since the half-value widths of the respective light absorption peaks are, respectively, at least 100 nm, the peaks are superposed in a wide range. Accordingly, if the sublimabilities or thermal diffusabilities of the dyes differ from each other, a black image with a given tone can be realized in a density-graded indication. In other words, when the images with different densities obtained by the use of a thermal transfer recording medium of the invention are subjected to measurement of values of a* and b* of the (CIE 1976)L*a*b* colorimetric system, it becomes possible that these values are within ranges where the hues do not suffer any significant change ($-10 \leqq a^* \leqq 10$ and $-5 \leqq b^* \leqq 5$).

It will be noted that if dyes which have similar sublimabilities or thermal diffusabilities are used in combination as the first and second dyes, there can be formed a black color image with a given tone in density-graded indication.

The ratio of the first and second dyes may differ depending on the light absorptivities of the dyes. In general, the first dye is used in an amount of from 35 to 65 wt %, preferably from 40 to 60 wt %, based on the total of the first and second dyes and, correspondingly, the second dye is used in an amount of 65 to 35 wt %, preferably from 60 to 40 wt %.

The first dye is preferably at least one member selected from disazo dyes of the following formulae (1) to (5)

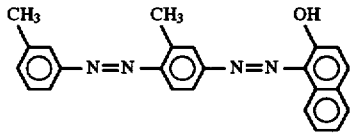
(1)

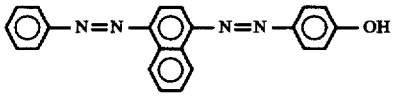
(2)

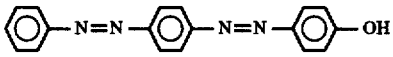
(3)

(C.I. Disperse Yellow 23)

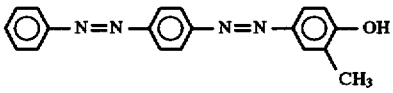
(4)

(C.I. Disperse Yellow 7)

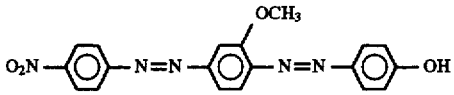
(5)

(C.I. Disperse Orange 29)

The second dye is preferably at least one member selected from isothiazole azo dyes of the following formulae (6) to (8)

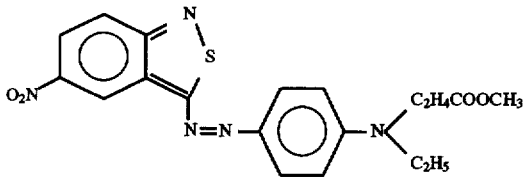
(6)

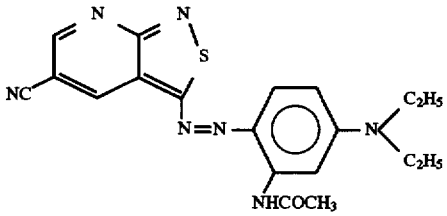
(7)

(EP26596 Al)

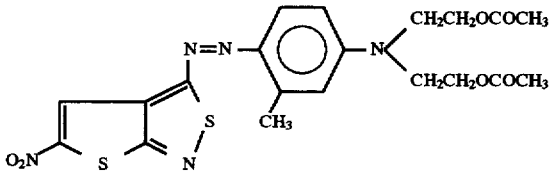
(8)

(GB1563221 A)

Figure 2:
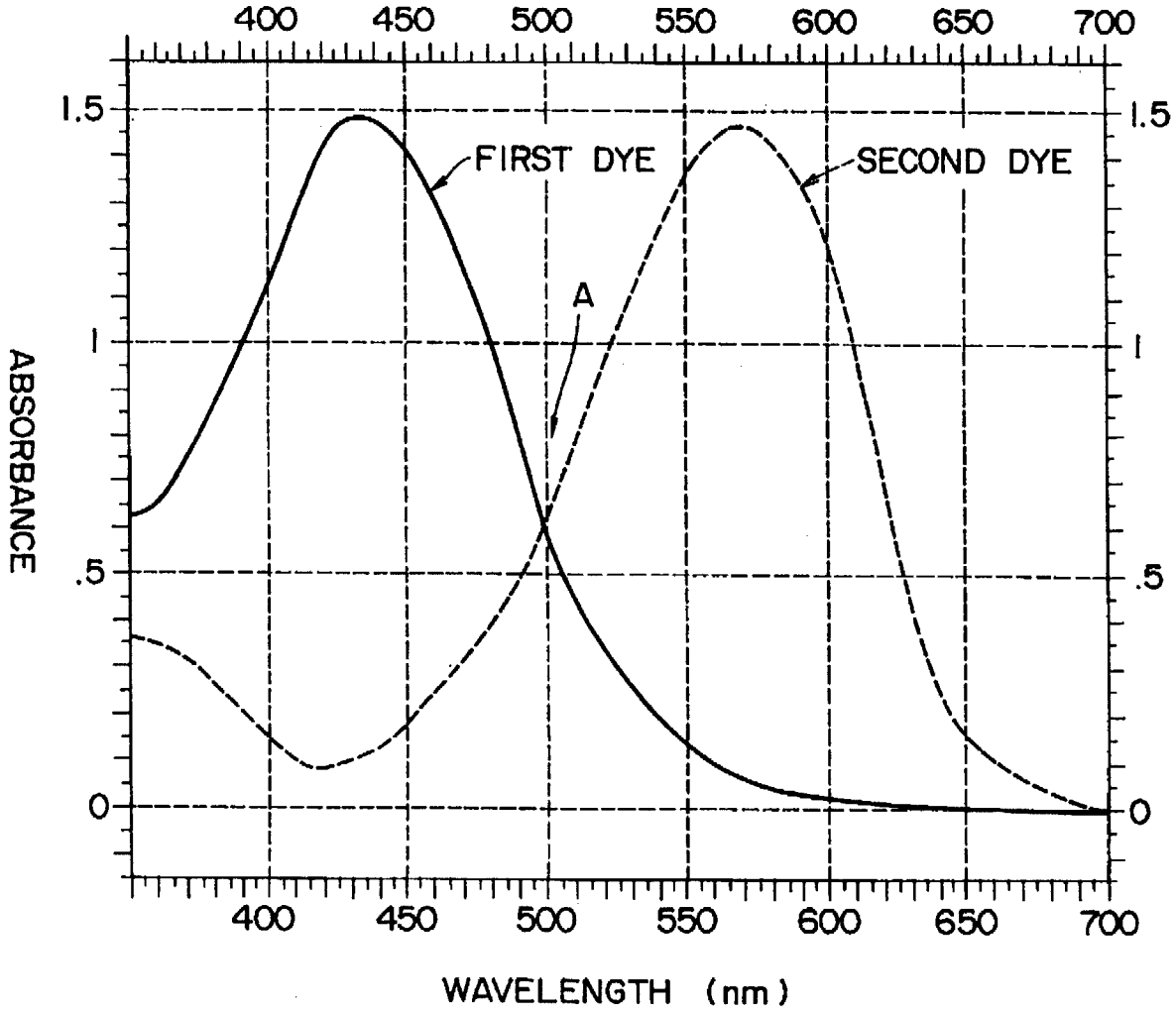
FIG. 2 is a graph illustrating the concept of the invention.
Figure 3:
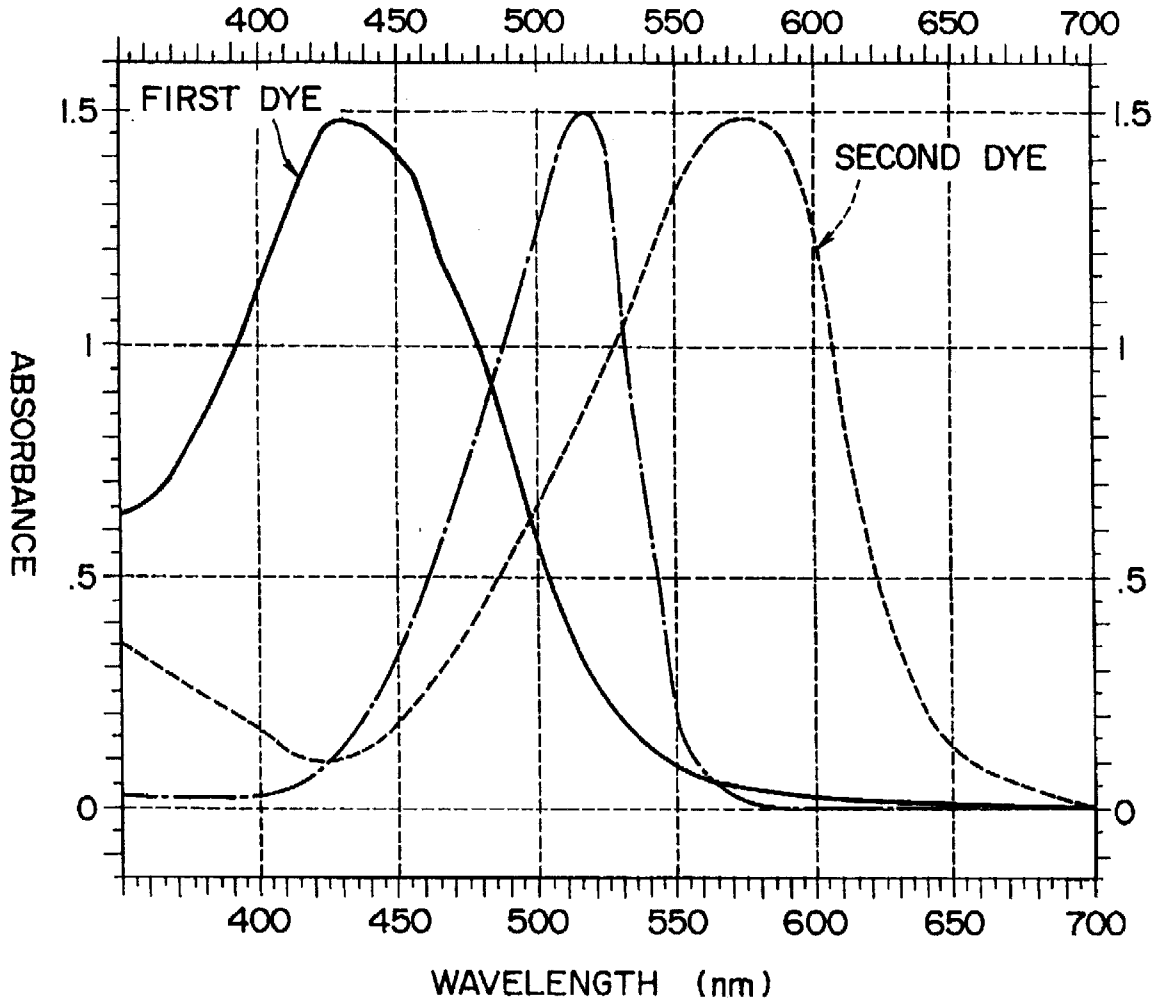
FIG. 3 is a graph showing a light absorption characteristic of three dyes used in combination according to the invention.
Figure 4:
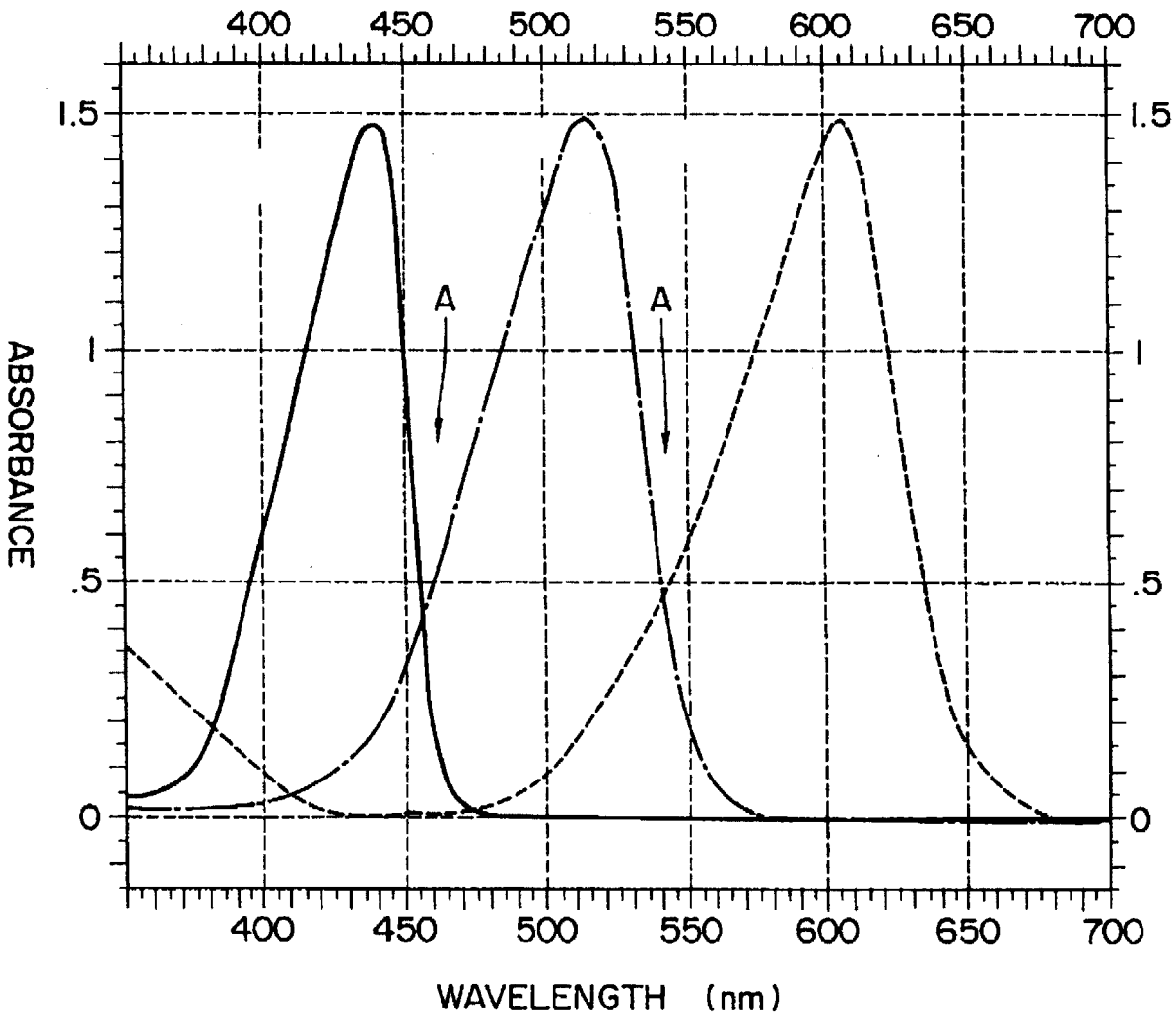
FIG. 4 is a graph illustrating the concept of the invention.
Figure 5:
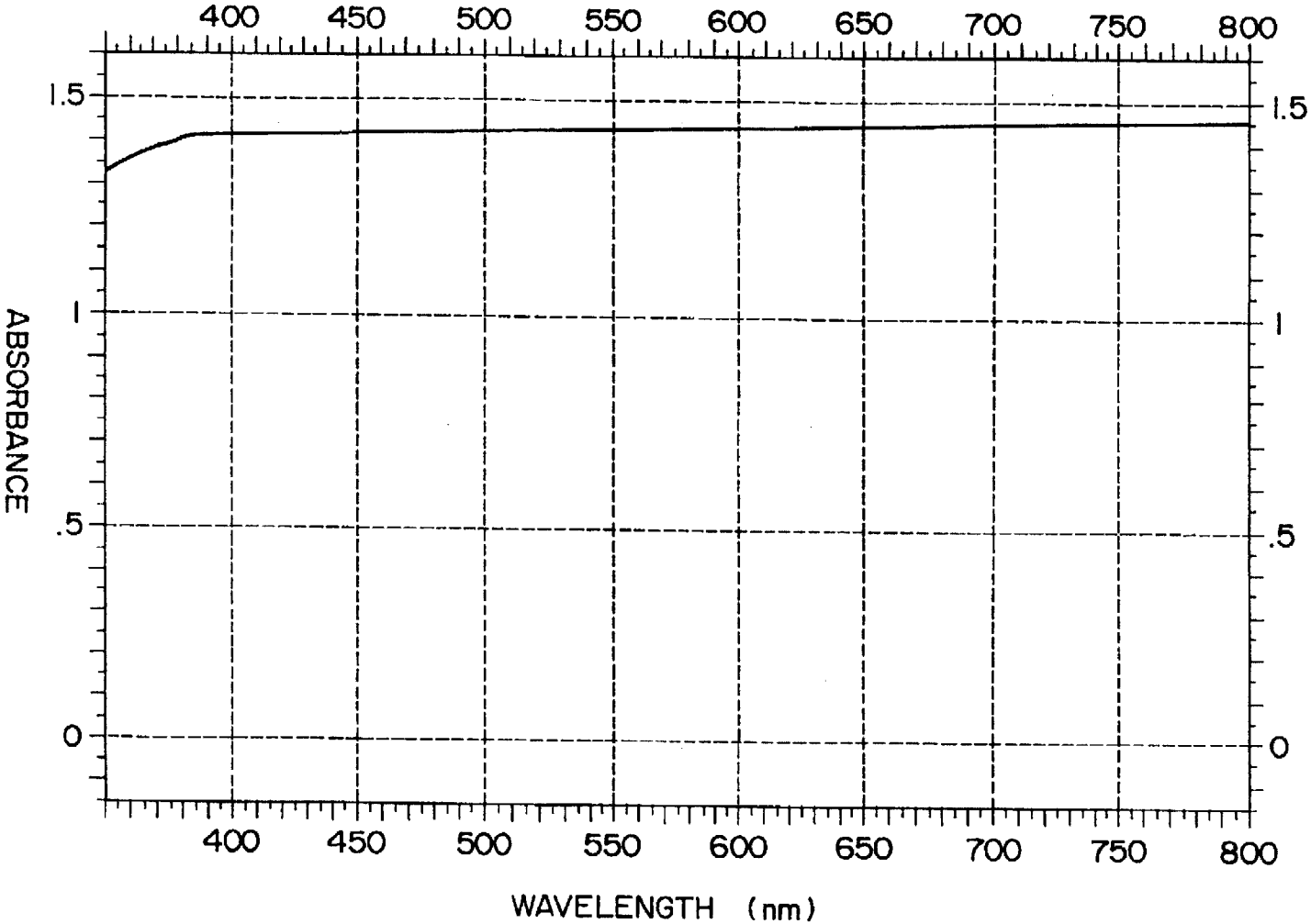
FIG. 5 is a graph showing a flat light absorption characteristic attained according to the invention.

The ink layer of the medium of the invention may further comprise, in addition to the first and second dyes, a third dye which has a light absorption peak whose maximum absorption wavelength, $\lambda_{max}$, of 500 to 550 nm. This is because depending on the types of first and second dyes, it is preferred to increase the light absorption in a range of 500 to 550 nm as is particularly shown in FIG. 2. In the case, when a third dye (e.g. a red dye) which has light absorption in that range is added to the combination of the first and second dyes, a flat light absorption can be attained in the visible light range as shown in FIG. 3. The resultant image will have a color closer to a black color. For a similar reason, a fourth dye or blue dye having a light absorption peak with a maximum absorption wavelength, $\lambda_{max}$, of 620 to 680 nm may be added. Of course, both third and fourth dyes may be added to the ink layer along with the first and second dyes.

The third and fourth dyes may be each added to in amounts not larger than 10 parts by weight, preferably from 4 to 8 parts by weight, per 100 parts by weight of the total of the first and second dyes.

The third dye is preferably at least one member selected from azo dyes, tricyanomethine dyes, benzothiazole dyes and anthraquinone dyes. Preferable examples of such dyes are shown in the following formulae (9) to (12)

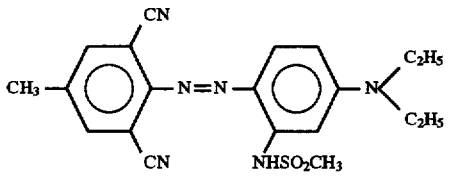
(9)

azo dye

-continued

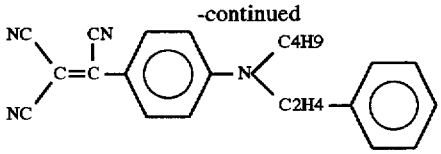

(10)

tricyanomethine dye

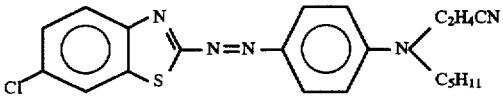

(11)

benzothiazole dye

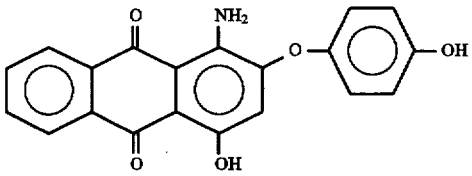

(12)

anthraquinone dye

The fourth dye is preferably be at least one dye selected from the group consisting of indoaniline dyes of the following formulae (13) and (14)

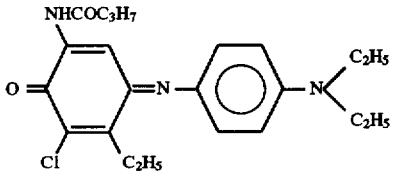

(13)

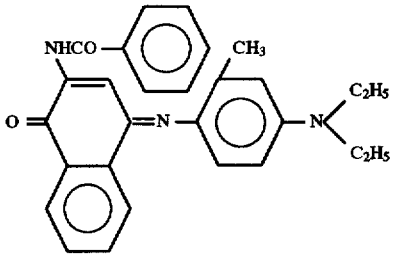

(14)

In the practice of the invention, the number of dyes added to the ink layer of the medium can be reduced as compared with prior art mediums. Accordingly, the dyes can be added to the ink layer at such a high concentration that the ratio by weight between the dyes and a binder is in a wide range of from 0.5:1 to 3.0:1. This permits formation of images with a desired density. If the ratio between the dyes and the binder is reduced, the storage property of the medium can be improved.

Aside from the ink layer of the medium according to the invention, the medium may be constituted of materials ordinarily used in this art. For instance, the substrate of the medium may be in the form of a film which is made, for example, of polyesters such as polyethylene terephthalate, polyimides, polyamides, aramides and the like. The binder resins used in the ink layer may be butyral resins, polyvinyl alkylacetals, cellulose esters, cellulose ethers, urethane resins and the like.

The substrate and the ink layer are not critical with respect to the thickness and may be determined depending on the purpose. The substrate may be provided with a heat-resistant, lubricating layer at a side opposite to the ink layer.

The thermal transfer recording medium of the invention can be applied in a manner ordinarily used in the art. For instance, the ink layer of the medium is superposed on an ordinary printing sheet having a dye receiving layer which is made, for example, of polyester resins, cellulose ester resins, urethane resins, epoxy resins, vinyl chloride-vinyl acetate resins or the like. Then, the medium is selectively heated by a heating means such as a thermal head in an imagewise pattern such as of video signals. The dye is transferred to the printing sheet by sublimation or thermal diffusion and fixed on the dye receiving layer thereby forming an intended image.

The thermal transfer recording medium of the invention makes use of at least two types of dyes whose maximum absorption wavelengths differ from each other and which have, respectively, a half-value width of at least 100 nm. When used for image formation by density gradation, the resultant black color image can be formed without substantially producing any hue shift in a full density range.

The present invention is more particularly described by way of examples.

Examples 1 to 10 and Comparative Examples 1 to 12

Ingredients indicated in Table 1 were uniformly mixed to obtain ink compositions. Each composition was applied, by means of a coil bar, onto a polyethylene terephthalate Film (thickness 6 μm, 6CF53 available from Toray Ltd.) which had been subjected to heat-resistant, lubricating treatments on one side thereof to obtain a thermal; transfer ink ribbon. Dyes used in the examples and comparative examples were mixtures of dyes indicated in Tables 2 and 3. In Comparative Example 1, SUMIPLAST BLACK 2BA of Sumitomo Chem. Co., Ltd. was used. In Comparative example 2, SUMIPLAST BLACK G of Sumitomo Chem. Co., Ltd. was used.

TABLE 1

Ink Composition

| Ingredient | Parts by Weight |
|---|---|
| Dye | 6.54 |
| Butyral Resin (6000 EP, Denka Butyral Co., Ltd.) | 3.27 |
| Methyl ethyl ketone | 47.75 |
| Toluene | 42.43 |

TABLE 2

| Example | Formula No. of Dye | Wt % | Example | Formula No. of Dye | Wt % |
|---|---|---|---|---|---|
| 1 | (1) | 45 | 6 | (1) | 35 |
| | (6) | 55 | | (6) | 65 |
| | (9) | 7 | | (9) | 10 |
| 2 | (1) | 45 | 7 | (1) | 65 |
| | (6) | 55 | | (6) | 35 |
| | (9) | 6.5 | | (9) | 19 |
| | (13) | 6.5 | | | |
| 3 | (1) | 55 | 8 | (1) | 65 |
| | (6) | 45 | | (6) | 35 |
| | (9) | 7 | | (9) | 10 |
| | | | | (13) | 10 |
| 4 | (1) | 45 | 9 | (1) | 35 |
| | (6) | 56 | | (6) | 65 |
| | (10) | 7 | | (9) | 10 |
| | | | | (13) | 10 |
| 5 | (1) | 45 | 10 | (1) | 45 |
| | (6) | 55 | | (6) | 55 |
| | (11) | 7 | | (9) | 7 |

TABLE 3

| Comp. Ex. | Formula No. of Dye | Wt % | Comp. Ex. | Formula No. of Dye | Wt % |
|---|---|---|---|---|---|
| 3 | (1) | 74 | 8 | (1) | 35 |
| | (6) | 26 | | (6) | 65 |
| | (9) | 5 | | (9) | 11 |
| 4 | (1) | 26 | 9 | (1) | 35 |
| | (6) | 74 | | (6) | 65 |
| | (9) | 5 | | (9) | 11 |
| 5 | (1) | 53 | 10 | (1) | 35 |
| | (6) | 47 | | (6) | 65 |
| | (9) | 18 | | (9) | 10 |
| | | | | (13) | 11 |
| 6 | (1) | 32 | 11 | (1) | 65 |
| | (6) | 68 | | (6) | 35 |
| | (9) | 5 | | (9) | 10 |
| | | | | (13) | 11 |
| 7 | (1) | 68 | 12 | (1) | 47 |
| | (6) | 32 | | (6) | 53 |
| | (9) | 5 | | (9) | 15 |

Each of the thus fabricated thermal transfer ink ribbons and a commercially available printing sheet having a polyester image-receiving layer (VPM-30ST of Sony Co., Ltd.) were set in a thermal transfer printer (CVP-G500 of Sony Co., Ltd.) and subjected to a twelve gradation stear step printing operation. In Example 10, a printing sheet used was made in the following manner. A 150 μm thick synthetic paper (FPG-150) was applied with an image-receiving layer composition with a formulation indicated in Table 4 in a dry thickness of 10 μm, followed by curing at 50° C. for 48 hours to obtain a printing sheet having a cellulose ester image-receiving layer.

TABLE 4

Formulation of Image-receiving Layer Composition

| Ingredient | Parts by Weight |
|---|---|
| Cellulose ester resin (CAB 500-5, E. Kodak) | 20 |
| Dicyclohexyl phthalate (Osaka Organic Chem. Co., Ltd.) | 4 |
| Modified Silicone Oil (SF8427, Toray · Dow Corning Inc.) | 0.6 |
| Fluorescent brightener (Ubitex OB, Chiba-Geigy) | 0.4 |
| Isocyanate crosslinking agent (Takenate D-110N, Takeda Pharm. Ind. Co., Ltd.) | 1.0 |
| Methyl ethyl ketone | 50 |
| Toluene | 50 |

The resultant print images were evaluated in the following manner.

1. Measurements on (CIE1976)L*a*b* Colorimetric System

The print images were each observed with a spectrophotometer (MCPD-1000, Otsuka Electron Co., Ltd.). The values of a* and b* of the twelve step gradation-indicated image are shown in Table 5. If both values of a* and b* are within ranges of $-10 \leqq a^* \leqq 10$ and $-5 \leqq b^* \leqq 5$, it can be evaluated as no practical problem on hue shift.

2. Printing density (Max density)

Each image was subjected to measurement of a maximum density by means of a Macbeth densitometer (Status Filter). The results are shown in Table 4. If the maximum density is higher than 1.8, the image can be evaluated as involving no practical problem.

3. Migration

A synthetic paper (FPG-60, Oji-Yuka Synthetic Paper Ltd.) was superposed on a maximum density image, followed pressing at a load of 40 g/cm$^2$ under which the image was aged at 60° C. for 48 hours. The dye density migrated on the synthetic paper was measured by means of the Macbeth densitometer. The results are shown in Table 5. A small value is considered to be lower in migration and the value is preferably not larger than 0.02 from the practical standpoint.

TABLE 5

| | Max. Density | Migration | Range of a* | Range of b* |
|---|---|---|---|---|
| Example: | | | | |
| 1 | 2.3 | 0.01 | 0→+9.0 | 0→+2.0 |
| 2 | 2.5 | 0.02 | −1.5→+0.5 | −2.5→0 |
| 3 | 2.4 | 0.01 | 0→+8.0 | 0→+4.0 |
| 4 | 2.3 | 0.01 | −0.5→+7.5 | 0→+4.0 |
| 5 | 2.3 | 0.01 | −0.5→+8.0 | 0→−2.0 |
| 6 | 2.3 | 0.01 | 0→+9.0 | −4.0→+1.0 |
| 7 | 2.3 | 0.01 | 0→+9.0 | 0→+4.5 |
| 8 | 2.5 | 0.02 | 0→+7.5 | 0→+4.5 |
| 9 | 2.5 | 0.02 | −1.0→+5.0 | −4.0→+0.5 |
| 10 | 2.4 | 0.01 | 0→+8.5 | 0→+2.0 |
| Comparative Example: | | | | |
| 1 | 1.6 | 0.05 | 0→+5.0 | 0→−12.0 |
| 2 | 1.5 | 0.04 | 0→+10.0 | 0→+10.0 |
| 3 | 2.0 | 0.01 | 0→+7.5 | 0→+7.5 |
| 4 | 2.0 | 0.01 | −2.5→+2.5 | −12.0→0 |
| 5 | 2.2 | 0.02 | 0→+20.0 | 0→+2.0 |
| 6 | 2.2 | 0.01 | 0→+5.0 | −10.0→0 |
| 7 | 2.3 | 0.01 | 0→+10.5 | 0→+6.0 |
| 8 | 2.3 | 0.01 | 0→+10.5 | −3.5→0 |
| 9 | 2.3 | 0.01 | 0→+10.5 | 0→+4.0 |
| 10 | 2.4 | 0.02 | −1.0→+7.5 | −6.0→0 |
| 11 | 2.4 | 0.02 | −0.5→+6.0 | −0.5→+6.0 |
| 12 | 2.2 | 0.01 | 0→+20.0 | 0→+2.0 |

As will be apparent from Table 5, all the mediums of the examples and comparative examples except for Comparative Examples 1 and 2 are satisfactory from the practical standpoint with respect to the maximum density and migration. However, good results are obtained only in the examples with respect to the density-graded indication. More particularly, in examples 1 to 10, both values of a* and b* in the (CIE1978)L*a*b* colorimetric system are within the ranges of $-10 \leqq a^* \leqq 10$ and $-5 \leqq b^* \leqq 5$ and the hue shift is reduced in the density-graded indication. On the other hand, with Comparative Examples 1 to 12, either of the values of a* and b* exceeds the ranges of $-10 \leqq a^* \leqq 10$ and $-5 \leqq b^* \leqq 5$. Thus, when the density-graded indication is made, a great hue shift results.

What is claimed is:

1. A thermal transfer recording medium which comprises a substrate and an ink layer formed on the substrate, the ink layer comprising a first dye having a light absorption peak which has a maximum absorption wavelength, $\lambda_{max}$, of 420 to 500 nm and a half-value width of at least 100 nm and a second dye having a light absorption peak which has a maximum absorption wavelength, $\lambda_{max}$, of 570 to 650 nm and a half-value width of at least 100 nm and wherein a black color image produced from the medium has a substantially constant hue in a density-graded indication.

2. A thermal transfer recording medium according to claim 1, wherein the first dye is present in an amount of from 35 to 65 wt % and the second dye is present correspondingly in an amount of from 65 wt % to 35 wt %, each based on the total of the first and second dyes.

3. A thermal transfer recording medium according to claim 1, wherein said first dye is a disazo dye and said second dye is an isothiazole azo dye.

4. A thermal transfer recording medium according to claim 3, wherein said diazo dye is at least one member selected from the group consisting of compounds of the following formulae (1) to (5)

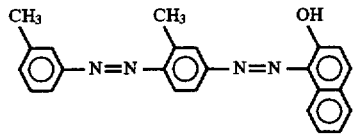
(1)

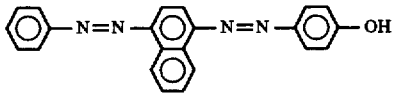
(2)

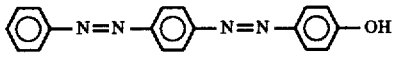
(3)

(C.I. Disperse Yellow 23)

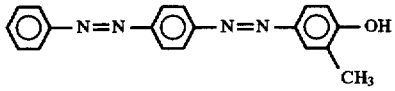
(4)

(C.I. Disperse Yellow 7)

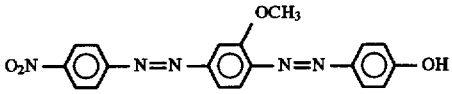
(5)

(C.I. Disperse Orange 29)

and said isothiazole azo dye is at least one member selected from the group consisting of compounds of the following formulae (6) to (8)

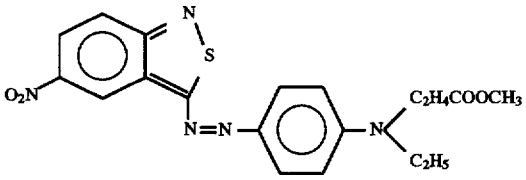
(6)

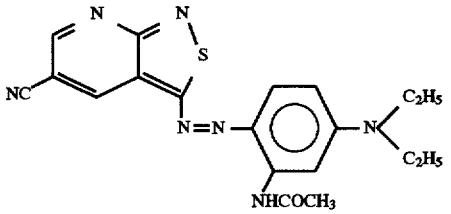
(7)

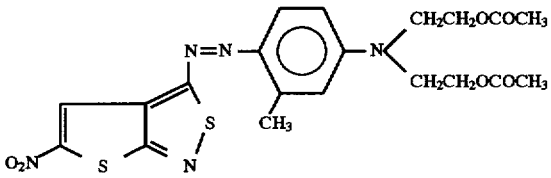
(8)

5. A thermal transfer recording medium which comprises a substrate and an ink layer formed on the substrate, the ink layer comprising a first dye having a light absorption peak which has a maximum absorption wavelength, $\lambda_{max}$, of 420 to 500 nm and a half-value width of at least 100 nm, a second dye having a light absorption peak which which has a maximum absorption wavelength, $\lambda_{max}$, of 570 to 650 nm and a half-value width of at least 100 nm, and at least one member selected from a third dye having a light absorption peak whose maximum absorption wavelength, $\lambda_{max}$, ranges 500 to 550 nm and a fourth dye having a light absorption peak whose maximum absorption wavelength, $\lambda_{max}$, ranges 620 to 680 nm.

6. A thermal transfer recording medium which comprises a substrate and an ink layer formed on the substrate, the ink layer comprising:

a) a first dye having a light absorption peak which has a maximum absorption wavelength, $\lambda_{max}$, of 420 to 500 nm and a half-value width of at least 100 nm;

b) a second dye having a light absorption peak which has a maximum absorption wavelength, $\lambda_{max}$, of 570 to 650 nm and a half-value width of at least 100 nm; and c) at least one member of the group comprising a third dye and a fourth dye, the third dye having a light absorption peak which has a maximum absorption wavelength, $\lambda_{max}$, of 500 to 550 nm and a half-value width of at least 100 nm, and a fourth dye having a light absorption peak which has a maximum absorption wavelength, $\lambda_{max}$, of 620 to 680 nm and a half-value width of at least 100 nm;

wherein said first dye is present in an amount from 35 to 65 wt % and said second dye is present correspondingly in an amount of from 65 to 35 wt %, each based on the total of the first and second dyes, and the third dye and/or fourth dye is individually present in an amount of up to 10 parts by weight per 100 parts by weight of the total of the first and second dyes.

7. A thermal transfer recording medium according to claim 6, wherein said first dye is a disazo dye, said second dye is an isothiazole azo dye, said third dye is an azo dye, a tricyanomethine dye, a benzothiazole dye or an anthraquinone dye, and said fourth dye is an indoaniline.

8. A thermal transfer recording medium according to claim 7, wherein said diazo dye is at least one member selected from the group consisting of compounds of the following formulae (1) to (5)

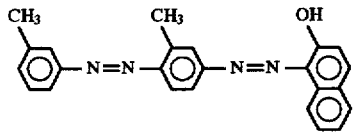
(1)

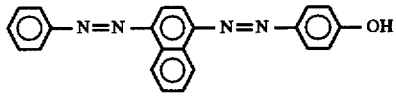
(2)

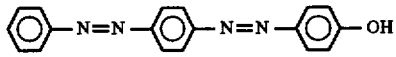
(3)

(C.I. Disperse Yellow 23)

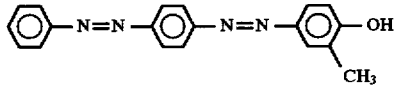
(4)

(C.I. Disperse Yellow 7)

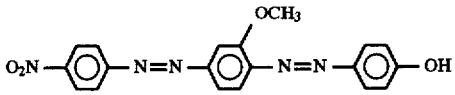
(5)

(C.I. Disperse Orange 29)

said isothiazole azo dye is at least one member selected from the group consisting of compounds of the following formulae (6) to (8)

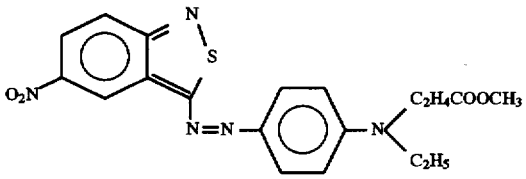
(6)

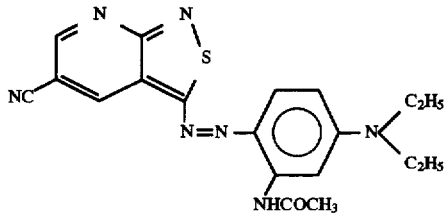
(7)

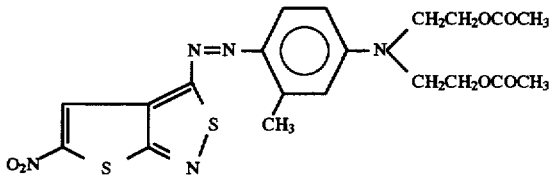
(8)

the azo dye, the tricyanomethine dye, the benzothiazole dye and the anthraquinone dyes are, respectively, of the following formulae (9) to (12)

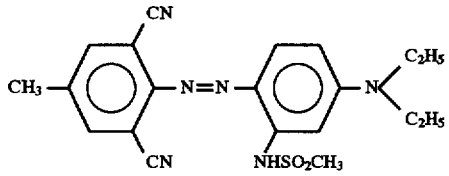
(9)

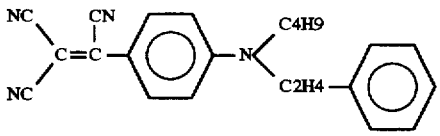
(10)

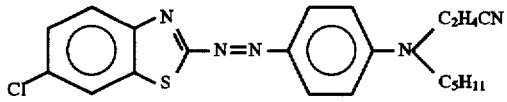
(11)

-continued

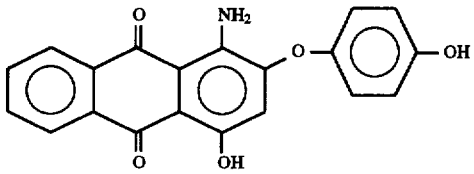
(12)

and the indoaniline is at least one member selected from the group consisting of compounds of the following formulae (13) and (14)

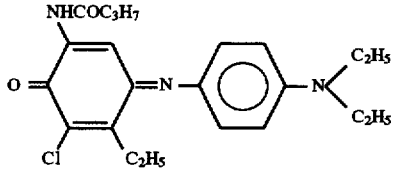
(13)

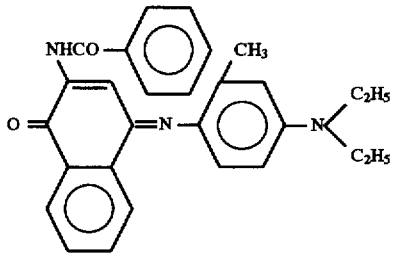
(14)

9. A thermal transfer recording medium which comprises a substrate and an ink layer formed on the substrate, the ink layer comprising a first dye having a light absorption peak which has a maximum absorption wavelength, $\lambda_{max}$, of 420 to 500 nm and a half-value width of at least 100 nm and a second dye having a light absorption peak which has a maximum absorption wavelength, $\lambda_{max}$, of 570 to 650 nm and a half-value width of at least 100 nm and wherein a black density-graded image produced by the medium has a substantially constant hue with $-10 \leqq a^* \leqq 10$ and $-5 \leqq b^* \leqq 5$, according to the CIE (1976) L*a*b* Colorimetric system.

* * * * *